US008288641B2

(12) United States Patent
Wilson

(10) Patent No.: US 8,288,641 B2
(45) Date of Patent: Oct. 16, 2012

(54) PORTABLE HAND-HELD MUSIC SYNTHESIZER AND NETWORKING METHOD AND APPARATUS

(75) Inventor: Andrew T. Wilson, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 2285 days.

(21) Appl. No.: 10/684,167

(22) Filed: Oct. 10, 2003

(65) Prior Publication Data

US 2004/0069122 A1 Apr. 15, 2004

(51) Int. Cl.
*G10H 7/00* (2006.01)

(52) U.S. Cl. ..... 84/645; 84/625; 84/660

(58) Field of Classification Search ..... 84/625, 84/660, 645

See application file for complete search history.

(56) References Cited

U.S. PATENT DOCUMENTS

| | | | | |
|---|---|---|---|---|
| 5,225,618 | A * | 7/1993 | Wadhams | 84/602 |
| 5,606,143 | A | 2/1997 | Young | 84/600 |
| 5,808,224 | A | 9/1998 | Kato | 84/609 |
| 6,025,553 | A | 2/2000 | Lee | 84/610 |
| 6,084,168 | A * | 7/2000 | Sitrick | 84/477 R |
| 6,278,048 | B1 | 8/2001 | Lee | 84/610 |
| 6,281,424 | B1 * | 8/2001 | Koike et al. | 84/636 |
| 6,372,974 | B1 | 4/2002 | Gross et al. | 84/609 |
| 6,392,133 | B1 * | 5/2002 | Georges | 84/609 |
| 6,423,892 | B1 * | 7/2002 | Ramaswamy | 84/609 |
| 6,989,484 | B2 | 1/2006 | Gross | |
| 7,709,725 | B2 | 5/2010 | Toledano | |
| 2002/0148343 | A1 | 10/2002 | Gross | |
| 2003/0121400 | A1 * | 7/2003 | Wilson | 84/609 |
| 2003/0121401 | A1 * | 7/2003 | Ito | 84/625 |
| 2003/0167904 | A1 * | 9/2003 | Itoh | 84/609 |
| 2004/0069122 | A1 | 4/2004 | Wilson | |
| 2006/0130636 | A1 | 6/2006 | Toledano | |
| 2007/0283799 | A1 | 12/2007 | Carruthers | |
| 2010/0218664 | A1 | 9/2010 | Toledano | |
| 2011/0023690 | A1 | 2/2011 | Wilson | |

OTHER PUBLICATIONS

LAN/MAN Standards Committee of the IEEE Computer Society, IEEE Std 802-11a-1999, Part II: Wireless LAN Medium Access Control (MAC) and Physical Layer (PHY) specifications: High-Speed Physical Layer in the 5 GHz Band, pp. i-viii-1-83.

LAN/MAN Standards Committee of the IEEE Computer Society, IEEE Std 802-11b-1999, Part II: Wireless LAN Medium Access Control (MAC) and Physical Layer (PHY) specifications: High-Speed Physical Layer Extension in the 2.4 GHz Band, pp. i-viii-1-89.

* cited by examiner

*Primary Examiner* — Jeffrey Donels
(74) *Attorney, Agent, or Firm* — Marger Johnson & McCollom PC

(57) ABSTRACT

The apparatus involves a hand-held housing with a memory for storing coded audio event data, a mechanism for downloading into the memory coded audio event data and digital-audio electronics for retrieving coded audio event data from memory, converting it to an audio signal and playing it out. In one disclosed embodiment of the invention, the data are stored in accordance with a musical instrument digital interface (MIDI) standard, and may be created on an appropriately equipped personal computer (PC). The capacity of such a hand-held device is far greater than if the data were conventionally digitized or coded. A wirelessly networked system of such music devices in physical proximity is disclosed that enables audio score synthesis and mixing by at least one such device of a synthesized score and an inputted score for outplay to others in a real-time musical jam or music-sharing session.

13 Claims, 7 Drawing Sheets

PORTABLE HAND-HELD MUSIC SYNTHESIZER AND NETWORKING METHOD AND APPARATUS

BACKGROUND OF THE INVENTION

The invention relates generally to portable digital audio play-out devices. More particularly, it concerns the provision of high-quality, high-volume digital audio file format compatible with downloading music to a portable hand-hand held device. Even more particularly, it concerns the so-called 'swarm' or ad-hoc networking of physically proximate portable hand-held MIDI music devices for real-time peer-to-peer musical jamming or music-sharing.

Portable MP3 players such as the Intel PocketConcert™ player provide a convenient way to transport music while traveling. However, even the best-known methods of audio compression, e.g. MP3, still produce extremely large files. For example, an hour of music compressed to 128 kilobits/sec (kbps) with MP3 occupies approximately 64 megabytes (MB) of memory. Such a large memory requirement limits range of access to portable music and for many is prohibitively expensive.

PCM audio, e.g. audio CDs or WAV files, are created by sampling a continuous audio signal and recording the amplitude in digital form. Those of skill in the art will appreciate that such a recording format is very data intensive and requires very high-bandwidth (e.g. 1.2 megabits/second (1.2 Mbps) data input/output (I/O) and data processing pathways and proportionately very high-capacity memory storage.

Conventional portable MP3 or Windows Media players and music synthesizer programs on desktop personal computers (PCs) transform time-domain PCM signals into frequency-domain audio data and then compress the data to eliminate inaudible frequency ranges. Such compressed-audio data files nevertheless require high-bandwidth processing (e.g. 128 kbps) and proportionately high-capacity memory storage. With desktop PCs, such large memory requirements are more easily met than with hand-held portable or pocket devices such as personal digital assistants (PDAs) or so-called pocket PCs. Those of skill in the art will appreciate that, the larger the memory, the more substantial the power requirement. Thus, large memories required to store even compressed, e.g. MP3, high-fidelity music-representative data in hand-held portable devices, also decrease useful battery life, which remains at a premium despite continuous developments in battery technology.

The musical instrument digital interface (MIDI), an existing music industry standard, is a common interface option on many desktop PCs. It provides a coding standard for synthesizing and recording musical events, e.g. note on, note off, attack, delay, pan, etc. Familiarity by those of skill in the art with the MIDI standard is assumed. Generally, the MIDI format is considered a compressed format because it does not require synthesis or storage of each and every nuance of continuous voice, pitch, duration, volume and envelope quality of a musical note, beat, phrase, score or lyric. Essentially, it is represents a computerized version, or coded, musical score that defines only musical events and their sequence, thereby significantly reducing the overhead of such detailed, high-bandwidth audio sampling and recording techniques. Typically, a MIDI file requires only approximately 12 kbps in bandwidth and proportionately smaller memory storage capacity.

Accordingly, wider access to music synthesis in a convenient, portable format combined with compressed audio playback capability is desired. Moreover, real-time peer-to-peer ad-hoc 'jamming' or music-sharing using a plurality of physically proximate portable hand-held MIDI music devices is desired.

DETAILED DESCRIPTION

Those of skill in the art will appreciate that an MP3 or other compressed audio file typically stores multiple digitized waveform patterns at a given high resolution, the patterns representing continuous and continuously changing musical characteristics as pitch, volume, envelope duration, attack, decay, etc. Such files are high-resolution digital representations of actual sounds, and, as such, may be understood to require high-volume storage and high-bandwidth signal processing. Audio players using such audio file formats thus are characterized by greater physical size, power draw and cost and lower capacity and thus versatility.

Those of skill in the art will appreciate that a MIDI file stores only a sequence of coded musical events (notes, volumes, rhythm patterns) needed to create the piece. A MIDI score therefore occupies orders of magnitude (e.g. presently nearly two orders of magnitude) less space than even compressed audio. A 128 MB portable hand-held music synthesizer could hypothetically hold 100 hours or more of MIDI music. Intermixing MIDI tracks with MP3 tracks would give effective playing time somewhere between two hours (MP3 only) and 100 hours (MIDI only), depending upon the mix of formats. Those of skill in the art will appreciate that this mix may be user-selectable, thereby further personalizing use of the invented apparatus.

The present invention allows a user to create and arrange MIDI files on a desktop PC, and to download them and play them on a portable device. One embodiment of such a system would include one or more of the following features:

a) a portable, battery-powered audio player device with an on-board reduced instruction set computer (RISC) processor or digital signal processor (DSP);

b) a re-writable storage, e.g. flash memory, microdrive, mini-optical disc. etc. for storing MIDI files in the device;

c) a method for downloading files to the device from a desktop PC, whether wired (Universal Serial Bus (USB), FireWire) or wireless (Bluetooth, the IEEE 802.11a or 802.11b standards, published 1999);

d) on-device MIDI synthesizer software with fixed or rewritable instrument banks;

e) front-panel video-game type hand controls on the device facilitating user selection of musical volume and track selection (i.e. operational modes) elements of music synthesis during playback, e.g. tempo, expressiveness, looping, "funk," etc. (i.e. musical modes);

f) software in the PC for creating, editing, and downloading MIDI scores and voices to the device; and g) an ability also to play back MP3 or other compressed audio formats on the portable device and to intermix compressed audio files with MIDI files on playlists.

Figure 1:
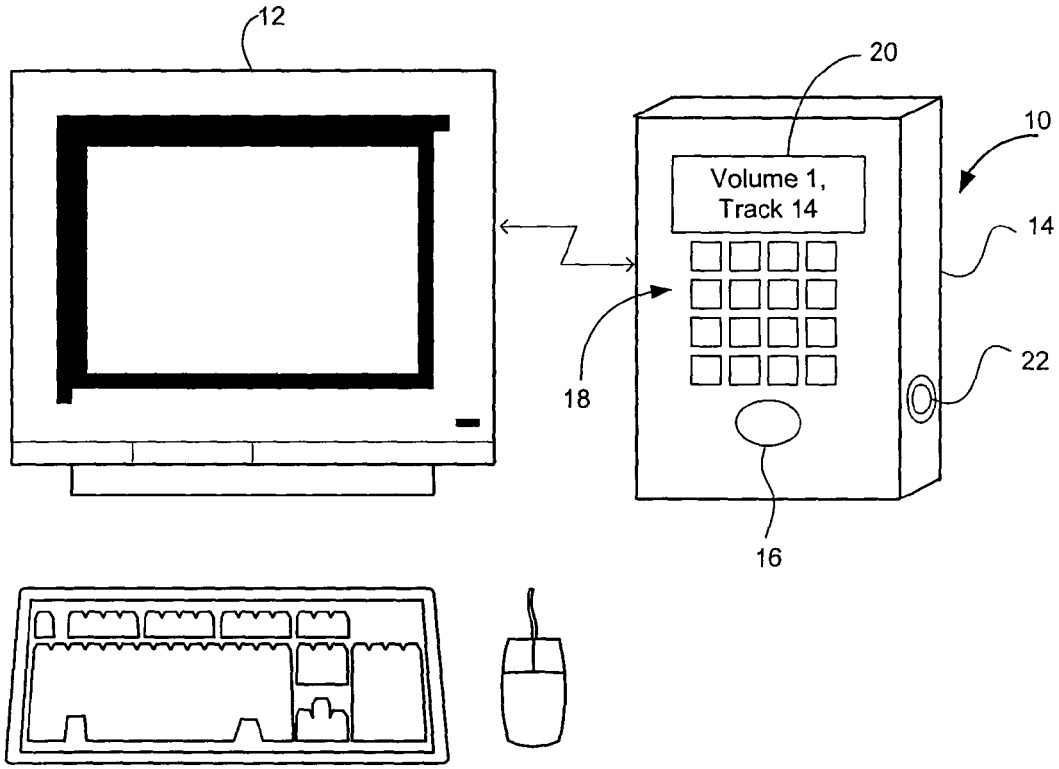
FIG. 1 is a system block diagram of the invented pocket music synthesizer in accordance with an embodiment of the invention, connected to a conventional desktop personal computer (PC).

FIG. 1 shows the invented apparatus 10 in accordance with one aspect of the invention, in system block diagram form, operatively connected, e.g. via a wireless communication mechanism, with a conventional desktop personal computer (PC) 12. Apparatus 10 will be understood to be lightweight and portable, e.g. hand-held, and to include a housing 14, a thumbpad 16, a keypad 18, a display 20 and a stereo headphone jack 22. Thumbpad 16 and keypad 18 will be referred to herein as front panel controls, or simply, user controls.

User controls 16, 18 may include any customized key cluster, including game pad-like controls such as finger- and/or thumb-actuated fire buttons, hat switches and traditional keypads. As is known, hat switches may be analogue in nature, e.g. they may be pressure-sensitive and highly responsive to user inputs. Such switches may be used for expression, pace and/or volume control. Thus, a user of apparatus 10 may enjoy ease and precision of control of musical sources to be played out, as well as of browsing and selection of musical albums and/or tracks.

Those of skill in the art familiar with pocket PCs will appreciate that housing 14 contains electronics to be described that permit user key entry via the front panel controls and feedback via display 20, which, for example, may display the current musical selection, as illustrated. Those of skill also will appreciate that the musical selection may be rendered audible to the user of apparatus 10 by use of a speaker or stereo headphone (not shown). Finally, those of skill will appreciate that musical selections may be downloaded from remote PC 12 into a memory within apparatus 10 on demand by the user, with PC 12 having been used to create what will be referred to herein as coded audio event data.

Figure 2:
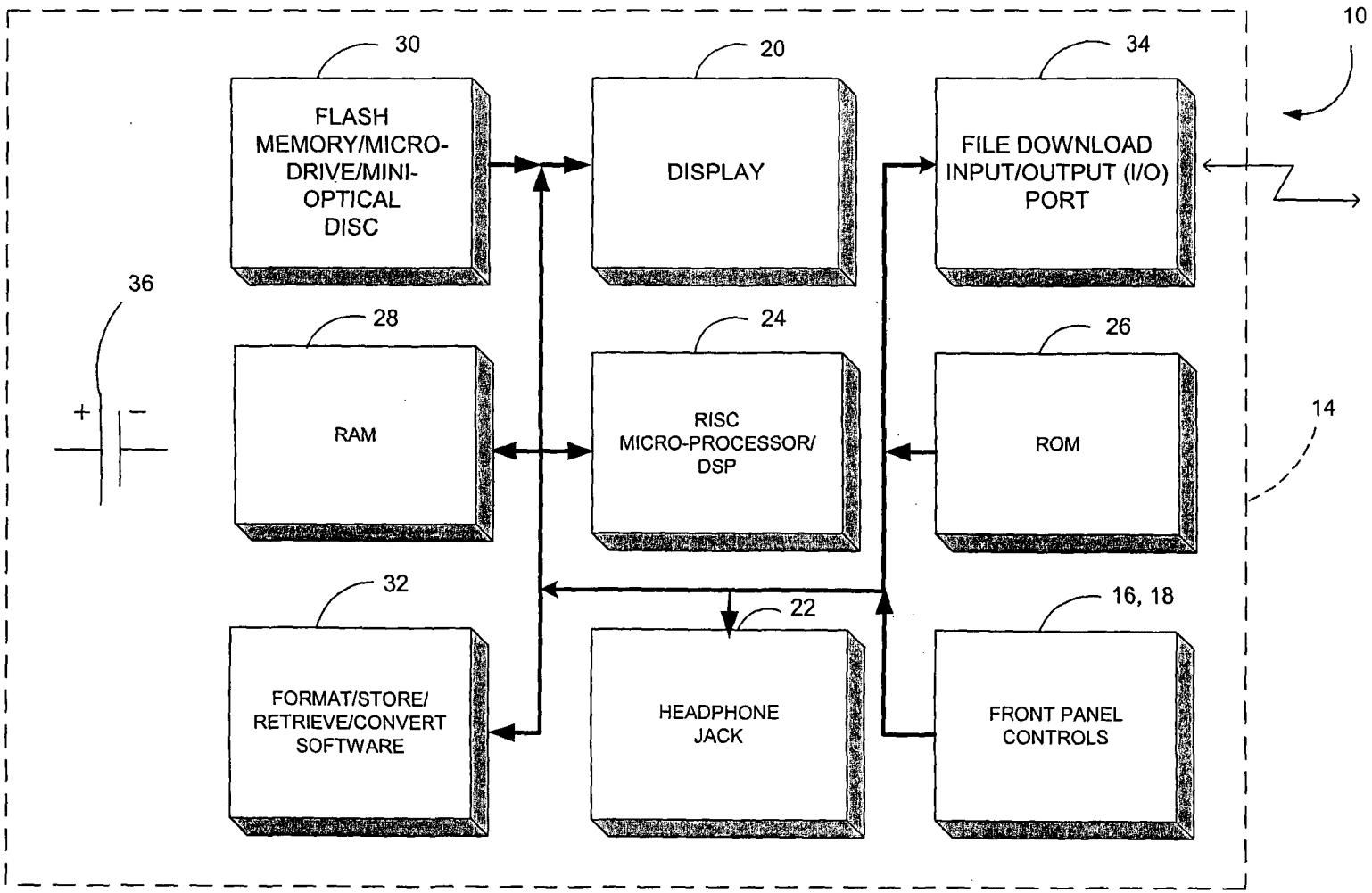
FIG. 2 is a detailed schematic diagram of the pocket music synthesizer of FIG. 1.

FIG. 2 shows apparatus 10 in simplified schematic block diagram form. Apparatus 10 within housing 14 may be seen to include externally accessible and visible front panel controls (thumbpad 16 and keypad 18), display 20 and headphone jack 22. The other blocks within apparatus 10 include a digital microprocessor, e.g. a RISC processor or digital signal processor (DSP) 24; a read-only memory (ROM) 26; a random-access memory (RAM) 28; a high-speed, high-capacity non-volatile memory (e.g. a flash memory, a micro-drive or mini-optical disk) 30; a software program 32 adapted to synthesizing an analogue audio signal by converting or decoding the coded audio event data; a file download input/output (I/O) port 34; and a battery 36.

Those of skill in the art will appreciate that the processor, memory and/or conversion functions may be differently configured, within the spirit and scope of the invention. Those of skill also will appreciate that the hand-held device and its display and control functions may also be differently configured, within the spirit and scope of the invention. The software and firmware functions and the user interface itself straightforwardly may be implemented using known development tools, operating systems and applications programs.

Figure 3:
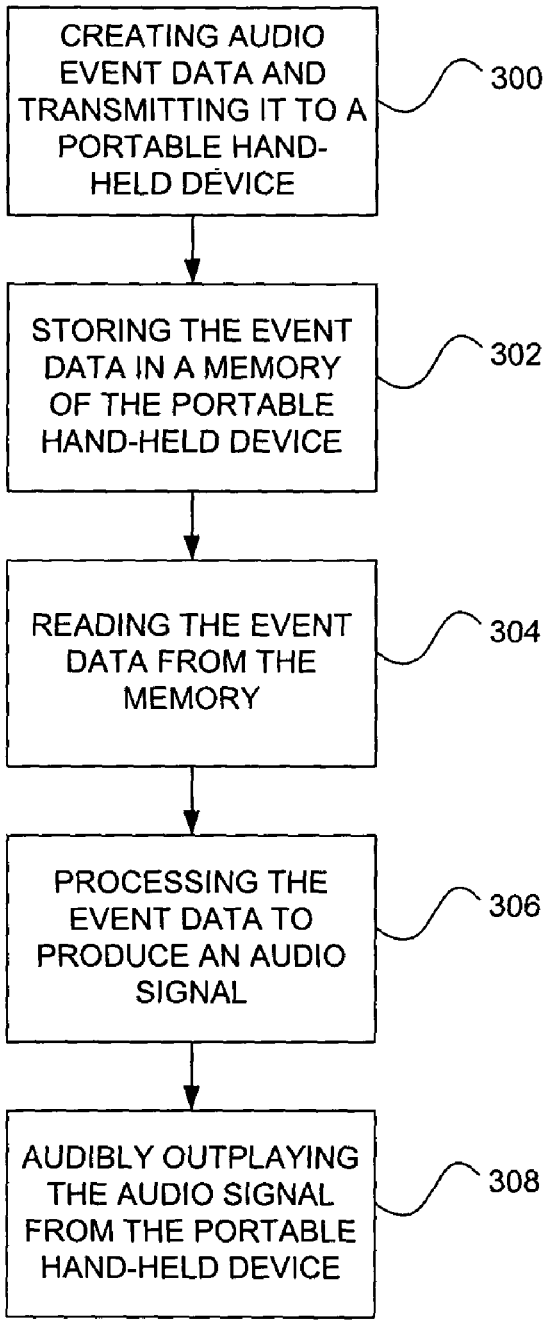
FIG. 3 is a flowchart illustrating the invented method in accordance with an embodiment thereof.

FIG. 3 illustrates the invented method of the invention in the form of a simplified flowchart. At 300, audio event data is created and transmitted to a hand-held device. At 302, the event data is stored in a memory of the portable hand-held device. (It will be appreciated that, typically, the event data is downloaded, e.g. from a remote PC or other processor, to the hand-held device. Such may be accomplished by any suitable means, e.g. via infrared, radio-frequency (RF) transmission or other wireless means such as Bluetooth, IEEEE 802.11, etc., or via a wired interface such as USB, FireWire, etc.) At 304, the event data is read from the memory. At 306, the event data is processed to produce an audio signal. Finally, at 308, the audio signal is audibly outplayed from the portable hand-held device. It will be appreciated by those of skill in the art that the process blocks are performed or assisted by software or firmware executing in a microprocessor or DSP or external PC or other external processor. For example, processing block 306 may be performed by software program 32 (see FIG. 2) stored as a series of instructions residing in RAM 28 and executing in RISC processor/DSP 24.

One drawback to synthesis is that, while current methods of music synthesis are capable of recreating instrumental sounds with excellent musical quality, they are not yet capable of synthesizing broadband vocals with high musical quality. Nevertheless, prospective buyers of the invented device might be older and more interested in personal expression and music creation than are typical purchasers of MP3. And of course advances in the capabilities of formatting, storing, retrieving, converting and playing out coded audio event data are expected to improve, as MIDI and alternative formats are further developed.

The portable hand-held music synthesizer apparatus would extend a supplier's audio product line by adding a high-tech capability not found in conventional MP3 players. It is a natural extension to desktop PC applications software, since scoring, arranging and editing MIDI music require a desktop PC. Such a desktop PC may include an installed base of music programs, e.g. SonicFoundry Acid™, which lets a user create professional-sounding MIDI files. The invention makes it possible conveniently and inexpensively to transport anywhere a large personal musical library.

FIGS. 4-7 illustrate various aspects of the invention by which real-time peer-to-peer jamming and/or music-sharing are rendered possible.

Figure 4:
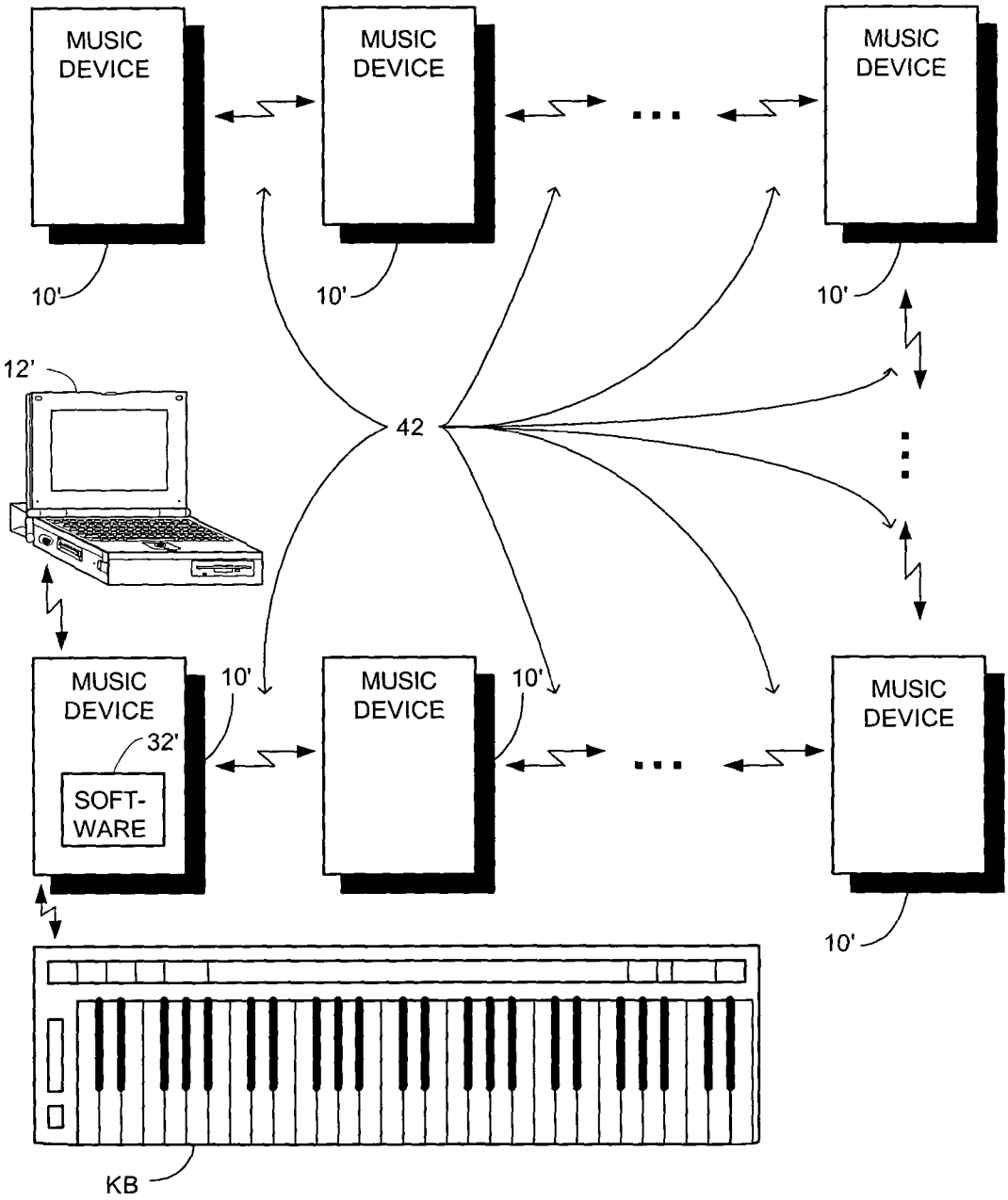
FIG. 4 is a system block diagram of the invented network of plural pocket music synthesizers in accordance with another embodiment of the invention.

FIG. 4 is a system block diagram illustrating the networking of plural portable hand-held MIDI music devices 10' similar to apparatus 10 described above. Those of skill in the art will appreciate that devices 10' differ from apparatus 10 described above in several particulars, as will be described in more detail below by reference to FIG. 5. First, plural instances of apparatus 10' are provided in a physically separate but also physical proximate configuration by which wireless communication therebetween is possible. Such wireless communication in one embodiment is in accordance with infrared (IR), radio-frequency (RF) transmission or other wireless means such as Bluetooth, IEEE 802.11, etc., or via a wired interface such as USB, FireWire, etc., as described above in connection with communication between apparatus 10 and an external PC. The plural instances of apparatus 10' include the same hardware mechanisms and most of the software or firmware mechanisms described above in connection with apparatus 10, but have further software features described below.

Software program 32' within a given instance of apparatus 10' is adapted further to input one or more audio scores, to synthesize an audio score and to mix the two or more audio scores in real time to produce a third audio score for outplay or transmission to at least one other networked instance of apparatus 10' similarly adapted. Those of skill in the art will appreciate that this novel mixing and outplay or transmission capability allows users of plural instances of apparatus 10' to synthesize, mix and outplay musical arrangements 'on the fly' in what will be referred to herein as a musical jam session.

There may be two or more such users of two or more instances of apparatus 10', and such a real-time peer-to-peer musical jam session may be referred to alternatively as a real-time peer-to-peer 'swarm' or ad-hoc musical jam session. The ability of apparatus 10' wirelessly to transmit an audio score to another physically proximate apparatus 10' also renders possible what will be referred to herein as real-time peer-to-peer music sharing, since the recipient apparatus 10' includes means for inputting and outplaying a received audio score.

FIG. 4 also shows a PC 12' in the form of a lightweight portable laptop that may be used to assist the audio score synthesis process for any or all instances of apparatus 10'. Those of skill in the art will appreciate that, depending upon the sophistication of apparatus 10' and any contemplated accessories, e.g. a musical (e.g. piano) keyboard KB, PC 12' may not be needed to synthesize an audio score as apparatus 10' itself has such audio score synthesis capability. Within the spirit and scope of the invention, any suitable means for audio score synthesis is contemplated, whether such synthesis functions are integral to housing 14 of apparatus 10', whether they are provided by an external accessory such as a general-purpose PC 12' (suitably programmed, e.g. similarly or identically, as described above with respect to PC 12) or dedicated musical keyboard or whether apparatus 10' itself takes the form of a musical keyboard. For example, it is contemplated that musical keyboard KB may be a so-called 'soft' or simulated keyboard presented on display 20 within housing 14 of apparatus 10' and operated manually or via a stylus or other suitable pointer. Alternatively, the piano and voice and command control functions may be distributed among thumbpad 16, keypad 18 and display 20, thereby obviating the external keyboard KB while providing full MIDI synthesis and mixing capability, within the spirit and scope of the invention.

Those of skill in the musical synthesis and mixing art will appreciate that plural instances of apparatus 10' are provided, in accordance with one embodiment of the invention, with a protocol (implemented in software or firmware) that enables plural users to configure one instance of apparatus 10' as a master for purposes of deciding various roles for the plural instances of apparatus 10' and to allocate, across the musical network, voices and instruments. Those of skill also will appreciate that the master would also direct the negotiation of which user and his/her associated one of plural instances of apparatus 10' will play, for example, lead, bass, percussion, etc. The master instance of apparatus 10' also would discover the presence in physical proximity of other instances of apparatus 10' capable of sharing musical data or engaging in a networked musical session.

Those of skill in the art will appreciate that the MIDI standard contemplates and provides for more compact musical or audio score representation than PCM or other sampled-waveform standards. Moreover, the MIDI standard contemplates plural musical voices, i.e. plural MIDI devices as audio sources. Thus, in one embodiment of the invention, MIDI is used as the data storage and exchange standard. But it is contemplated as being within the spirit and scope of the invention to support any suitable alternative musical representations. MIDI permits relatively low-bandwidth plug-in synthesis, mixing, sharing (transmitting and/or receiving) and playout of musical and/or vocal scores, in real time, full duplex (concurrent, bidirectional) telecommunication mode or operation of plural instances of apparatus 10'.

Synthesized or mixed MIDI data must, of course, be rendered for audible listening by users of apparatus 10'. Two topologies are contemplated in accordance with the invention, although any suitable alternatives are also within the spirit and scope thereof.

In accordance with a first proposed topology, one instance of apparatus 10' is configured as a master that acquires a musical data stream from one or more other instances of apparatus 10'. Those of skill in the art will appreciate that, in accordance with such a topology, a MIDI synthesis session would be running on a controller within the one instance of apparatus 10' that is configured as a master controller capable of directing the musical synthesis and mixing. Such a master controller also would assign various instruments to various voices represented in the other instances of apparatus 10' that desire to participate in the musical jam session. Other instances of apparatus 10' would be configured as slave controllers capable of synthesizing one or more voices and contributing the same via the network to the one instance of apparatus 10' that is configured as a master controller.

Those of skill in the art will appreciate that these master and slave roles for various instances of apparatus 10' are subject to change—i.e. a slave may negotiate with the designated master to yield master control to the slave, either between musical jam sessions or even during a given musical jam session.

In accordance with a second proposed topology, every instance of apparatus 10' is capable of receiving synthesized audio scores from one or more, e.g. every, other. The audio scores rendering may be in digital or analog form, and may utilize plural remote amplifiers and speakers or a central amplifier and speaker system. Alternatively, and within the spirit and scope of the invention, one or more instances of apparatus 10' in this second proposed rendering topologies could have a headphone for each jam session member. (Within the spirit and scope of the invention, relatively idle members of the jam session—who may make little or no musical synthesis contribution themselves, may nevertheless listen to the musical jam session using apparatus 10', in what may be referred to herein as a music-sharing network or system configuration.)

The bidirectional, real-time audio score conveyance, i.e. transmission and reception of analog or digital and, in one embodiment of the invention, MIDI data, is wireless, e.g. IR or RF, and, in keeping with one embodiment of the invention as contemplated, may be in accordance with Bluetooth, ITTC IEEE 802.11a, 802.11b, or an equivalent wireless communication standard. This is because IR generally requires relatively unobstructed line-of-sight, is less robust and requires closer physical proximity than does RF. Those of skill in the art will appreciate, however, that, within the spirit and scope of the invention, any suitable wireless conveyance capable of real-time, at least simplex and better full duplex, audio score transmission and reception between plural instances of apparatus 10' is contemplated.

It is contemplated as being within the spirit and scope of the invention that one or more users of apparatus 10' may contribute in real time an audio score, whether synthesized or downloaded from an external source, to the mix that produces an outplayable musical audio score. Each of such one or more contributors may contribute one or more voices, e.g. instrumental or vocal tracks, to the whole. Each in accordance with one embodiment of the invention may also monitor the jam session in real time, hearing their own contribution mixed in real time with the external source, e.g. a downloaded score or audio score contributions from one or more other contributors. It is also contemplated as being within the spirit and scope of the invention that there may be 'spectators' as well as 'players'. In other words, users of apparatus 10' may choose not to contribute input to the audio score but may nevertheless in physical proximity wirelessly 'listen in' to the ongoing jam session conducted by others.

Thus, in accordance with one embodiment of the invention, one instance of apparatus 10' capable of synthesizing and mixing an outplayable audio score may be wirelessly connected with another instance of apparatus 10' capable at least of receiving and outplaying the outplayable audio score produced in the one instance. Nevertheless, virtually any number of contributors may contribute and any number of listeners may listen to a musical jam session so long as they are equipped with an apparatus 10' at least minimally configured with the functions described and illustrated herein. Such listening only by certain users of apparatus 10' of outplayable and wirelessly transmitted audio scores produced by others realizes a feature of the invention referred to herein as music sharing.

Figure 5:
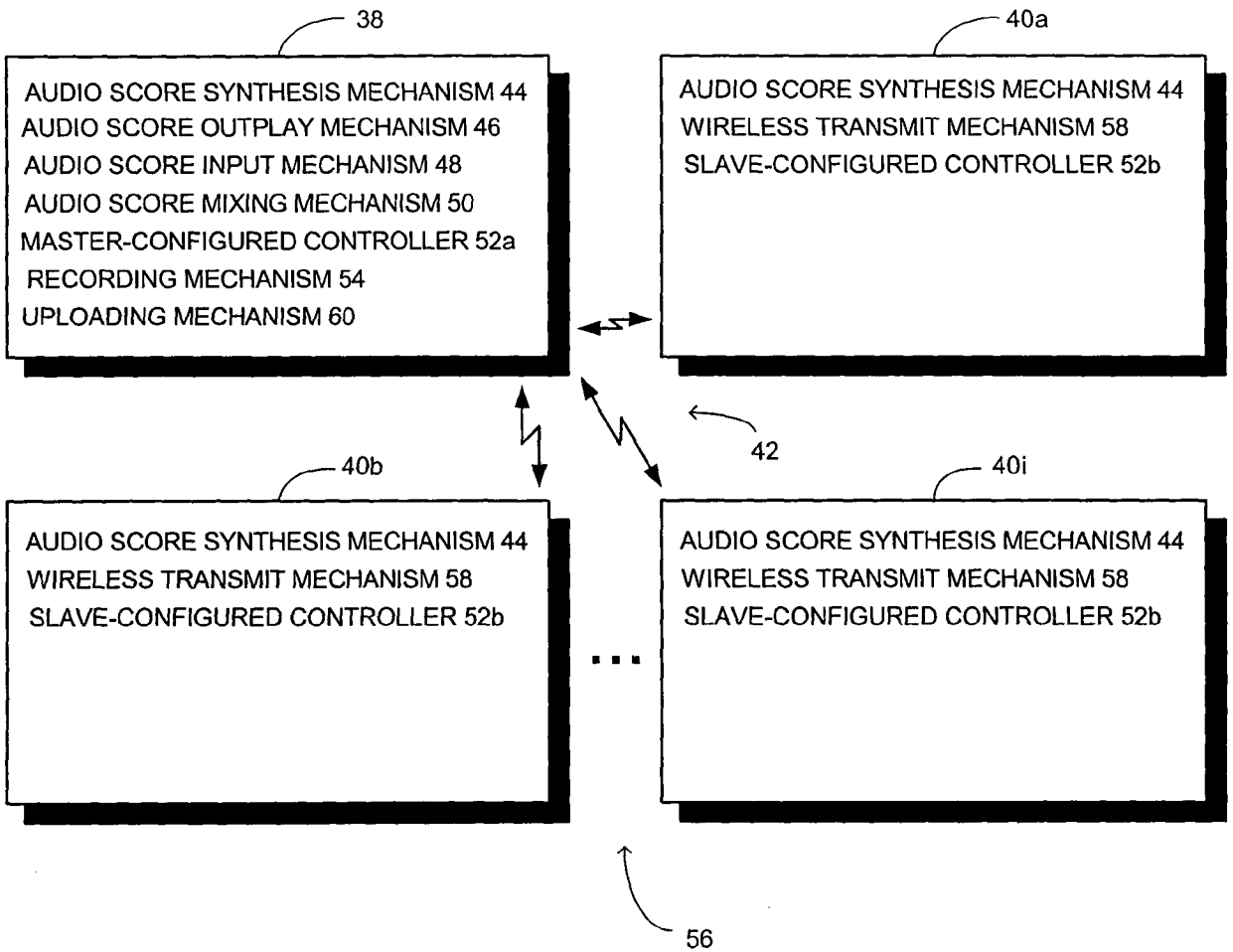
FIG. 5 is a detailed schematic diagram of a master and a slave music synthesizer within the network of FIG. 4.

FIG. 5 is a detailed schematic diagram illustrating a master-controller-configured version 38 and one or more slave-controller-configured versions 40*a*, 40*b*, . . . 40*i* of apparatus 10' operatively coupled via a wireless interconnect mechanism 42 (shown in FIGS. 4 and 5) configured wirelessly to transmit and receive audio scores in the form of digital data to and from an external source to be described. Master version 38 and slave versions 40*a*, 40*b*, . . . 40*i* of apparatus 10' will be understood by those of skill in the art to represent specially hardware, software, and/or firmware provisioned versions of apparatus 10' described above by reference to FIG. 4.

Master version 38 is programmed to characterize its apparatus 10' as a master capable of dictating a mode of operation for a network of plural instances of apparatus 10' configured as slave versions 40. Complementarily, slave versions 40*a*, 40*b*, . . . 40*i* are programmed as being capable of having such a mode of operation dictated by master version 38. In accordance with one embodiment of the invention, both master version 38 and slave versions 40*a*, 40*b*, . . . 40*i* include a) an audio score synthesis mechanism 44, b) an audio score outplay mechanism 46 configured to outplay an audio score, c) an audio score input mechanism 48 configured to input a received audio score from an external source wirelessly coupled with apparatus 10', and d) an audio score mixing mechanism 50 coupled with synthesis mechanism 44, audio score input mechanism 48 and outplay mechanism 46. Mixing mechanism 50 is configured to mix a synthesized audio score with a received-and-inputted audio score to produce an outplayable audio score having components of both the synthesized and the received-and-inputted audio score for outplay of the produced outplayable audio score by outplay mechanism 46.

Each of master and slave versions 38, 40*a*, 40*b*, . . . 40*i* of apparatus 10', in accordance with one embodiment of the invention, includes a controller 52 configured to characterize apparatus 10' alternatively as a master (version) 38 or as a slave (versions) 40*a*, 40*b*, . . . 40*i*. In accordance with one embodiment of the invention, each of master and slave versions 38, 40*a*, 40*b*, . . . 40*i* of apparatus 10' also includes a recording mechanism 54 (shown, for the sake of brevity, only in connection with master version 38) configured at least temporarily to store one or more audio scores.

Also in accordance with one embodiment of the invention, each of master and slave versions 38, 40*a*, 40*b*, . . . 40*i* of apparatus 10' also includes an upload mechanism 60 (shown, also for the sake of brevity, only in connection with master version 38) to upload one or more audio scores to an external processor, e.g. a central 'session host' computer such as desktop PC 12, laptop PC 12' or equivalent, whether proximate or remote to or from apparatus 10'. Those of skill in the art will appreciate that such uploading mechanism may be via a telecommunication medium (e.g. wireless), or may be accomplished within the spirit and scope of the invention by any alternative suitable conveyance, e.g. via audiotape, diskette, CDROM or other hard transportable medium.

Thus, the invention contemplates the ability—after a real-time, peer-to-peer jam session is at least substantially complete—to upload a recording of the jam session to a proximate or remote processor for further editing, archival recording, outplaying, CDROM programming (so-called 'burning') or alternative further musical production or post-production tasks.

Those of skill in the art will appreciate that the external audio source inputted by input mechanism 48 typically is another instance of apparatus 10'. More particularly, the external audio source of any given instance of apparatus 10' typically is the outplayable audio score as it is outplayed by one or more other instances of apparatus 10. Alternatively, of course, and within the spirit and scope of the invention, the external audio source inputted by input mechanism 48 may be a previously or concurrently broadcast and/or recorded audio score, e.g. turntable, radio, streaming audio, CDROM, DVD, audiotape or diskette or even a live audio performance. For example, a user of apparatus 10' might download an MP3 instrumental score and add another instrumental or vocal score thereover by local synthesis and mixing for outplay to a recording device, a set of headphones, a speaker or another wirelessly connected or networked instance of apparatus 10'

Thus, a system 56 of music devices is provided of physically proximate lightweight hand-held music devices coupled together in real time for music synthesis. System 56 may be seen from FIG. 5 in accordance with one embodiment of the invention to include operatively coupled plural apparatus 10' in physical proximity with each other and capable at least of one-way (and, in accordance with one embodiment of the invention, two-way, full duplex) communication therebetween of an audio score.

Those of skill in the art will appreciate that at least one such apparatus 10' in system 56 would include a) an audio score synthesis mechanism 44, b) an audio score mixing mechanism 50 coupled with synthesis mechanism 44 for mixing plural audio scores to produce another audio score having components of each of the plural audio scores and c) an audio score input mechanism 48 coupled with mixing mechanism 50 to provide one or more input audio scores thereto for mixing with the synthesized and outplayed audio score. It will be appreciated that synthesis mechanism 44, mixing mechanism 50 and input mechanism 48 are operable in real time to create an outplayable audio score having components of plural audio scores produced by plural proximate apparatus 10'.

Those of skill also will appreciate that at least another of such apparatus 10' in system 56 would include an audio score synthesis mechanism 44 and a transmit mechanism 58 for transmitting the synthesized audio score to such at least one apparatus 10' for mixing thereby.

Those of skill in the art will appreciate that, in accordance with one embodiment of system 56, slave versions 40*a*, 40*b*, . . . 40*i* each further include another instance of audio score outplay mechanism 46, audio score input mechanism 48, audio score mixing mechanism 50 and recording mechanism 54 similar to that of master version 38. Moreover, in accordance with one embodiment of the invention, each of master version 38 and slave versions 40*a*, 40*b*, . . . 40*i* are capable of being configured as either a master or a slave for a given musical jam or music-sharing session Thus, musical session control may be passed from one user to another also in real time. Finally, those of skill in the art will appreciate that in accordance with one embodiment of the invention, each of master version 38 and slave versions 40*a*, 40*b*, . . . 40*i* of apparatus 10' is provided also with all of the software or firmware and hardware features of apparatus 10, described in detail above.

Figure 6:
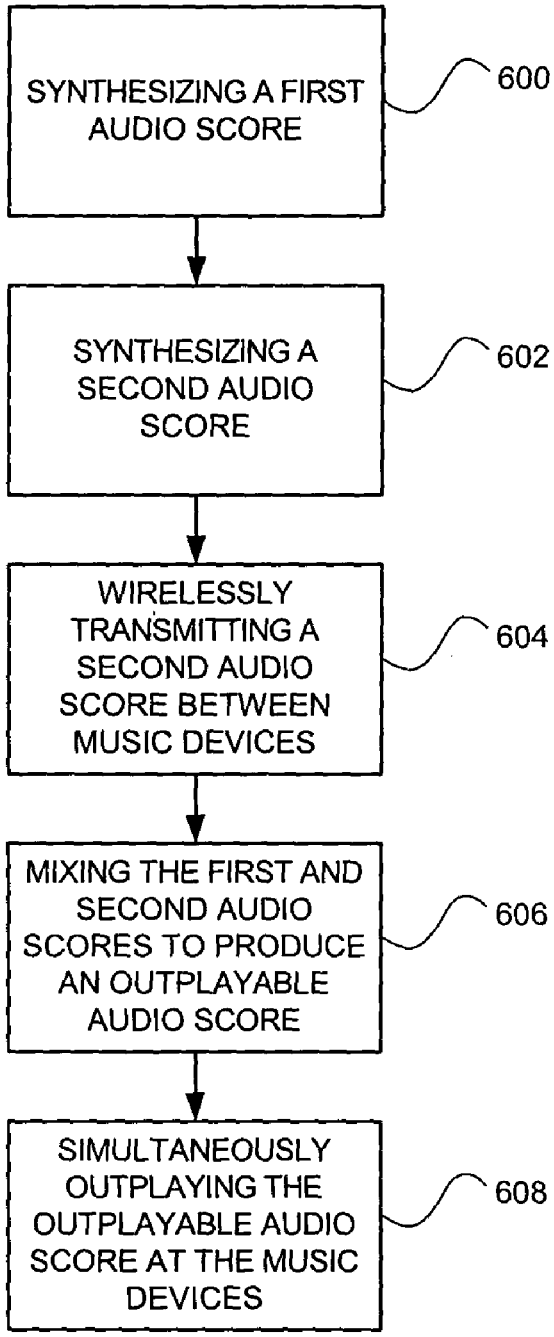
FIG. 6 is a flowchart illustrating one method of the invention by which a musical jam session occurs.

FIG. 6 is a flowchart illustrating the method of the invention in accordance with one embodiment. The illustrated plural user musical jam session method includes a) synthesizing a first audio score at 600 (whether at a first or a second one of two music devices), b) optionally synthesizing a second audio score at 602 (whether at a second or a first one of two music devices), c) wirelessly transmitting a second audio score (optionally the second audio score synthesized at 602, as opposed, for example, to a second audio score downloaded and recorded from an alternative external source) between music devices at 604, d) mixing the first and second audio scores (whether at the first or the second one of two music devices) to produce an outplayable audio score at 606 and e) approximately simultaneously outplaying the outplayable audio score at the music devices at 608.

Figure 7:
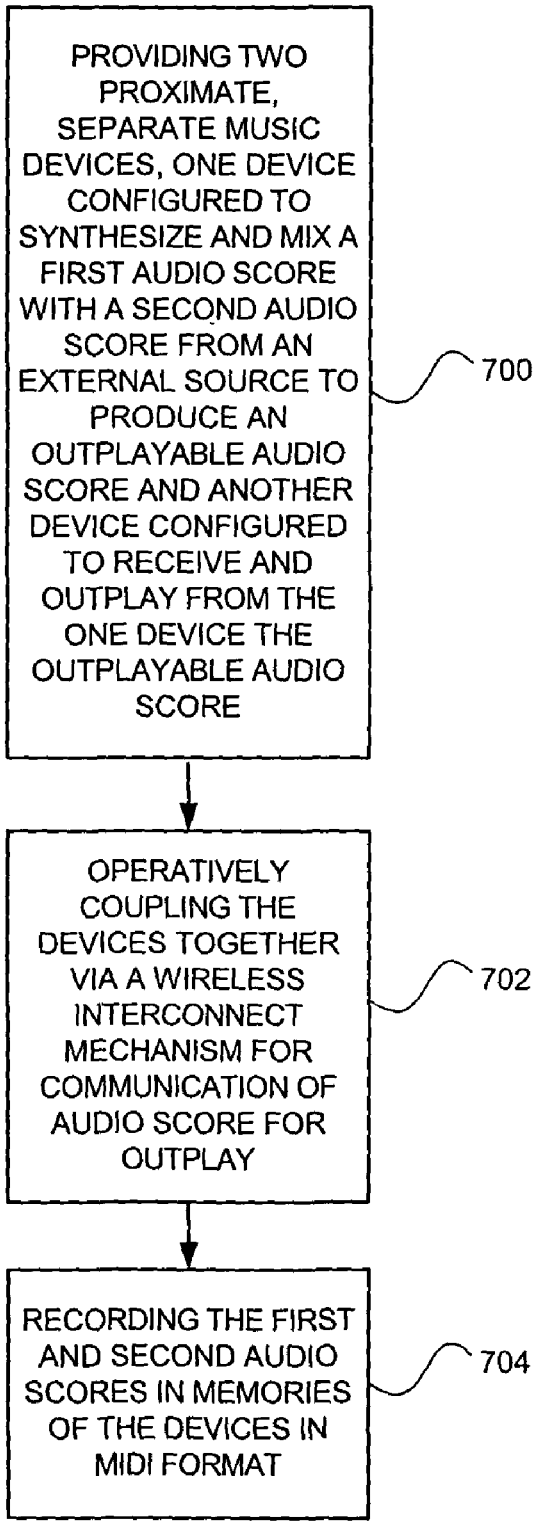
FIG. 7 is a flowchart illustrating another method of the invention by which a musical jam session occurs.

FIG. 7 is a flowchart illustrating the method of the invention in accordance with another embodiment. The illustrated plural user musical jam session method includes a) at 700 providing two proximate, separate music devices, one such device configured to synthesize a first audio score and to mix the same with a second audio score from an external source (which external device may be one of the two music devices) thereby to produce an outplayable audio score and another such device configured to receive and outplay from the one such device an outplayable audio score, b) at 702 operatively coupling the devices together via wireless interconnect mechanism for communication of the outplayable audio score for outplay and c) optionally at 704 recording the first and second audio scores in memories of the devices in MIDI format.

Those of skill in the art will appreciate that an event-coded and thus extremely compact digital format such as MIDI enables real-time interactive synthesis, mixing and monitoring among two or more users of apparatus 10' without running into bandwidth or fidelity limitations. It is contemplated, nevertheless, that the use of any suitable audio score format and wireless interconnect or networking mechanism is within the spirit and scope of the invention.

Finally, those of skill in the art will appreciate that the invented method and apparatus described and illustrated herein may be implemented in software, firmware or hardware, or any suitable combination thereof. In accordance with one embodiment of the invention, the method and apparatus are implemented in a combination of the three, for purposes of low cost and flexibility. Thus, those of skill in the art will appreciate that the method and apparatus of the invention may be implemented by a computer or microprocessor process in which instructions are executed, the instructions being stored for execution on a computer-readable medium and being executed by any suitable instruction processor. Alternative embodiments are contemplated, however, and are within the spirit and scope of the invention.

Having described and illustrated the principles of the invention in a preferred embodiment thereof, it should be apparent that the invention can be modified in arrangement and detail without departing from such principles. I claim all modifications and variation coming within the spirit and scope of the following claims.

The invention claimed is:

1. A system of music devices operatively coupled together, the system comprising:

plural apparatus in physical proximity with each other and capable of at least one-way communication therebetween of an audio score, at least two such apparatus each comprising:

an audio score synthesis mechanism including a playing mechanism for playing the synthesized audio score;

an audio score mixing mechanism coupled with said synthesis mechanism for mixing plural audio scores to produce another audio score having components of each of the plural audio scores;

an audio score input mechanism coupled with said mixing mechanism to provide one or more input audio scores thereto for mixing with the synthesized and played audio score, said synthesis mechanism, said mixing mechanism and said input mechanism being operable in real time to create a playable audio score having components of plural audio scores produced by said plural proximate apparatus, wherein one of the plural apparatus includes a controller that is designated as a master controller and another of the plural apparatus includes a controller that is designated as a slave controller, and wherein designation of the master controller and the slave controller is changeable in real-time;

a recording mechanism to store said playable audio score; and an upload mechanism to upload said playable audio score to an external processor for at least one of editing, archival recording, outplaying, and CDROM programming.

2. The system of claim 1, wherein:

the external processor is discrete from the plural apparatus.

3. The system of claim 1, wherein the playable audio score is in the form of digital data.

4. The system of claim 3, wherein the digital data is formatted in accordance with a musical instrument digital interface (MIDI) standard.

5. The system of claim 1, further comprising:

a wireless network; wherein said plural apparatus are capable of said communication therebetween over said wireless network.

6. The musical system of claim 5, wherein said wireless network takes the form of a WiFi or Bluetooth network.

7. The system of claim 1, further comprising a central session host computer, said central session host computer comprising said external processor.

8. The system of claim 7, wherein said central session host computer is proximate to each of said plural proximate apparatus.

9. The system of claim 7, wherein said central session host computer is remote to each of said plural proximate apparatus.

10. The system of claim 1, each of said plural proximate apparatus further comprising user controls to facilitate user selection of operational modes of music synthesis during playback of said playable audio score.

11. The system of claim 10, wherein said user controls comprise front panel controls.

12. The system of claim 11, wherein said front panel controls comprise at least one of a thumb pad and a keypad.

13. The system of claim 10, each of said plural proximate apparatus further comprising a display to display a current musical selection.

* * * * *

UNITED STATES PATENT AND TRADEMARK OFFICE

CERTIFICATE OF CORRECTION

PATENT NO. : 8,288,641 B2
APPLICATION NO. : 10/684167
DATED : October 16, 2012
INVENTOR(S) : Andrew T. Wilson It is certified that error appears in the above-identified patent and that said Letters Patent is hereby corrected as shown below:

Claim 6, Column 10, line 41, please delete the word "musical."

Signed and Sealed this
Twenty-sixth Day of February, 2013

Teresa Stanek Rea
*Acting Director of the United States Patent and Trademark Office*